US009873586B2

(12) United States Patent
Lam

(10) Patent No.: US 9,873,586 B2
(45) Date of Patent: Jan. 23, 2018

(54) MANUAL TAPING IMPLEMENT

(71) Applicant: LAMUS ENTERPRISES INC., Vancouver (CA)

(72) Inventor: Joe Augustine S. T. Lam, Vancouver (CA)

(73) Assignee: LAMUS TECHNOLOGIES INC., Vancouver, BC (CA)

( * ) Notice: Subject to any disclaimer, the term of this patent is extended or adjusted under 35 U.S.C. 154(b) by 214 days.

(21) Appl. No.: 14/624,895

(22) Filed: Feb. 18, 2015

(65) Prior Publication Data

US 2016/0236894 A1 Aug. 18, 2016

(51) Int. Cl.

| | |
|---|---|
| ***B44C 7/00*** | (2006.01) |
| ***B29C 65/00*** | (2006.01) |
| ***B65H 35/00*** | (2006.01) |
| ***B65H 37/02*** | (2006.01) |

(52) U.S. Cl.

CPC ..... *B65H 35/0033* (2013.01); *B65H 37/02* (2013.01); *B65H 2301/5154* (2013.01); *B65H 2402/412* (2013.01)

(58) Field of Classification Search

CPC ..... B65H 35/0013; B65H 35/002; B65H 35/0026; B65H 35/0033; B65H 35/0008

See application file for complete search history.

(56) References Cited

U.S. PATENT DOCUMENTS

| | | | | |
|---|---|---|---|---|
| 2,264,425 | A | 12/1941 | Witter | |
| 2,434,776 | A | 1/1948 | Van Cleef et al. | |
| 2,452,584 | A * | 11/1948 | Luebkeman | B65H 35/0033 156/523 |
| 2,506,504 | A | 5/1950 | Hudson | |
| 2,582,979 | A | 1/1952 | Fritzinger | |
| 3,523,053 | A | 8/1970 | Zbinden et al. | |
| 3,813,275 | A | 5/1974 | Weick et al. | |
| 4,253,905 | A | 3/1981 | Regan | |
| 4,345,966 | A | 9/1982 | Iiyoma et al. | |
| 4,762,586 | A | 8/1988 | Wilkie | |
| 5,197,386 | A * | 3/1993 | Lin | B41K 3/12 101/213 |
| 5,641,377 | A | 6/1997 | Chung | |
| 6,152,344 | A | 11/2000 | Jensen | |
| 6,799,623 | B1 | 10/2004 | Cheng | |
| 7,669,631 | B2 | 3/2010 | Balley et al. | |
| 8,393,375 | B2 | 1/2013 | Lam | |
| 8,800,630 | B1 | 8/2014 | Albanese et al. | |

OTHER PUBLICATIONS

Written Opinion and International Search Report for corresponding international application No. PCT/CA2016/050038, dated Apr. 21, 2016.

* cited by examiner

*Primary Examiner* — Alex Efta

(57) ABSTRACT

A manually operated taping device has a drawback mechanism to draw back the landing end of the tape immediately after the tape is cut and tape tension removed by extending a tape path between the tape source from which the tape is dispensed and an applicator for applying the tape and/or by minimizing the spacing between the applicator and the cutting knife used to cut the tape at the time the tape is cut. The device may also include a guide to better ensure the device is moved during tape application in the direction relative movement between the tape and device.

1 Claim, 8 Drawing Sheets

14,114
408
400
406
410
22,122
22,122
18,118

14,114
18,118
450
W
425
22,122

424
18,118
14,114
406
420
425
W
$\frac{1}{2}$W
422
22,122
426

MANUAL TAPING IMPLEMENT

FIELD OF INVENTION

The present invention relates to manual taping devices, more particular to an improved device that facilitates performance of the manual taping operation ergonomically.

BACKGROUND OF THE PRESENT INVENTION

Hand operated tapers have been available for many years as shown, for example, in U.S. Pat. No. 5,641,377 issued Jun. 24, 1997 inventor Chung and U.S. Pat. No. 6,799,623 issued Oct. 5, 2005 inventor Cheng. Generally all necessarily leave a relatively long free leading end portion that must be applied to the next object to be taped which impedes the taping operation. Normally these conventional hand operated tapers or so call tape dispensers require the operator to pull the free leading end portion with his fingers and then attach it onto the object to initiate the taping process. A cutting knife is also required since the tape is supplied as a continuous ribbon from a supply source that is normally a roll of such tape. The knife is usually positioned away from the tape path and the object to avoid accidental tape cut off or damaging the object during the taping process. Safety guard for the knife is also provided to prevent operator injuries. Above U.S. Pat. No. 5,641,377 discloses a knife retracts from its normal cutting position for safety purpose. U.S. Pat. No. 7,669,631 issued Mar. 2, 2010, inventor Bailey related limiting snap back of the free leading end of the tape.

In some manually activated tape dispensing devices the cutting operation is manually initiated by some form of triggering operation which presents the tape to the cutting blade to thereby sever the tape see U.S. Pat. No. 4,762,586 issued Aug. 9, 1988 to Wilkie; U.S. Pat. No. 4,345,966 issued Aug. 24, 1982 to Iiyoma et al.; U.S. Pat. No. 4,253,905 issued Mar. 3, 1981 to Regan; and U.S. Pat. No. 3,813,275 issued May 28, 1974 o Weick et al. The patents to Iiyoma et al and Weick et al together with U.S. Pat. No. 4,238,271 issued Dec. 9, 1980 to Urushizaki; U.S. Pat. No. 3,523,053 issued Aug. 4, 1970 to Zbinden et al; and U.S. Pat. No. 2,582,979 issued Jan. 22, 1952 to Fritzinger provide some form of withdraw system to move the free end of the tape away from the point of application, in most cases by physically moving the tape roll etc. In Weick et al a slide is manually released to change the orientation of the tape and over the applicator roll toward the tape roll from which the tape is being dispensed.

These device disclosed in the referenced patents rely solely on manual dexterity of the operator to move the device in the desired direction during the taping operation and/or in many cases to trigger tape cut-off to complete the operation.

BRIEF DESCRIPTION OF THE PRESENT INVENTION

It is an object of the present invention to provide a manually operated taping device has a drawback mechanism to draw back the leading end of the tape immediately after the tape is cut to provide a shorted fee end on the tape for application to the next object to be taped.

It is a further object of the present invention to provide a manually operated taping device with an applicator and cut-off mechanism to produce a short free end on the tape for application to the next object to be taped.

It is further object of the present invention to provide a manually operated taping devise has a an applicator and cut-off mechanism to provide a more desirable cutting angle to the knife and produce for a more positive cutting action and a cleaner cut edge on the tape.

It is a further object of the present invention to incorporate tape application guide that guides the device to better ensure movement of the device during tape application is in the direction relative movement between the tape and device.

Broadly the present invention relates to a manually operated tape applicator device comprising a frame, a tape source of tape to be applied by said applicator mounted on said frame, a handle extending from said frame, a tape path extending from said tape source to an applicator means for applying a leading end of said tape, a tape draw back device mounted on said frame, said draw back device including a tape retracting arm biased toward said tape path and moveable to an extended position when tension in the tape on said path is reduced to tape retracting position to displace said tape from a normal tape path when said tape is being dispensed from said tape roll under tension to a displaced position that forces said tape from said normal path to a retracting tape path thereby drawing a leading end of said tape back toward said tape roll.

Another way according to the present invention to attain a shortened free end on the tape and/or improve the cutting operation is by using a manually operated tape applicator comprising a frame, a tape source of tape to be applied by said applicator mounted on said frame, a handle extending from said frame, a tape path extending from said tape source to an applicator means for applying a leading end of said tape, mounting means mounting said applicator means on said frame, means biasing said applicator means from a retracted position toward to an initial position where said applicator means is in a position for said applying of said leading end of said tape.

The present invention also relates to a manually operated tape applicator comprising a frame, a tape source of tape to be applied by said applicator mounted on said frame, a handle extending from said frame, a tape path extending from said tape source to an applicator for applying a leading end of said tape, said tape extending in a direction of travel of said tape along said tape path, a tape guide provided by an edge mounted on said frame spaced from said handle and extending from said frame in a direction parallel to said direction of travel of said tape.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1B:
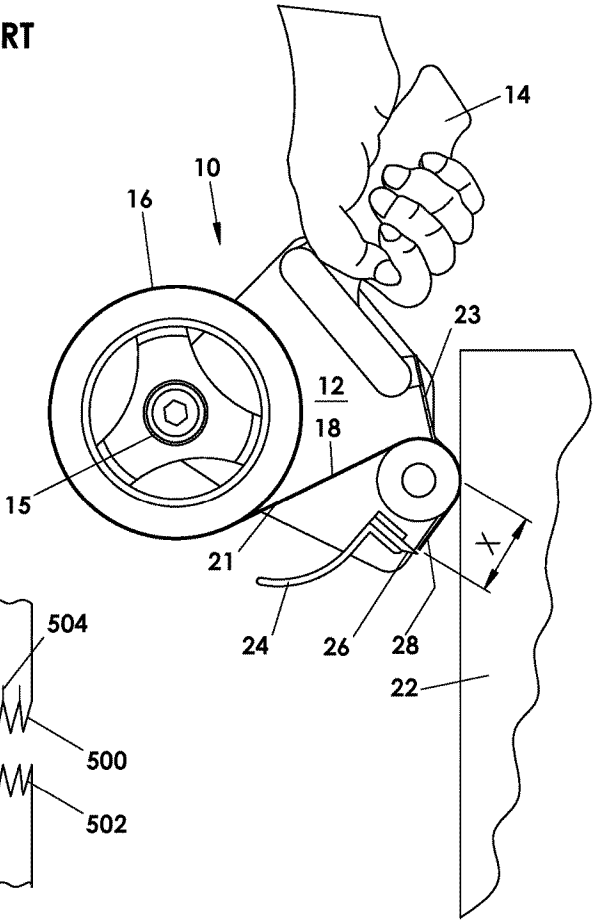
FIG. 1*b* (Prior art) Shows the same hand held tape applicator (FIG. 1*a*) at the position of applying tape on the front vertical surface of a carton.
Figure 1C:
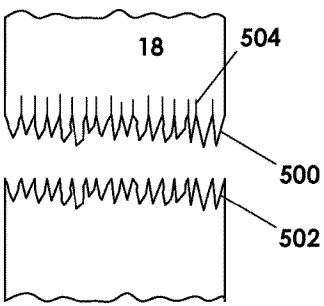
FIG 1c PRIOR ART
FIG. 1*c* (Prior art) the adjacent edges of a tape cut using the cutting system of the prior art
Figure 1A:
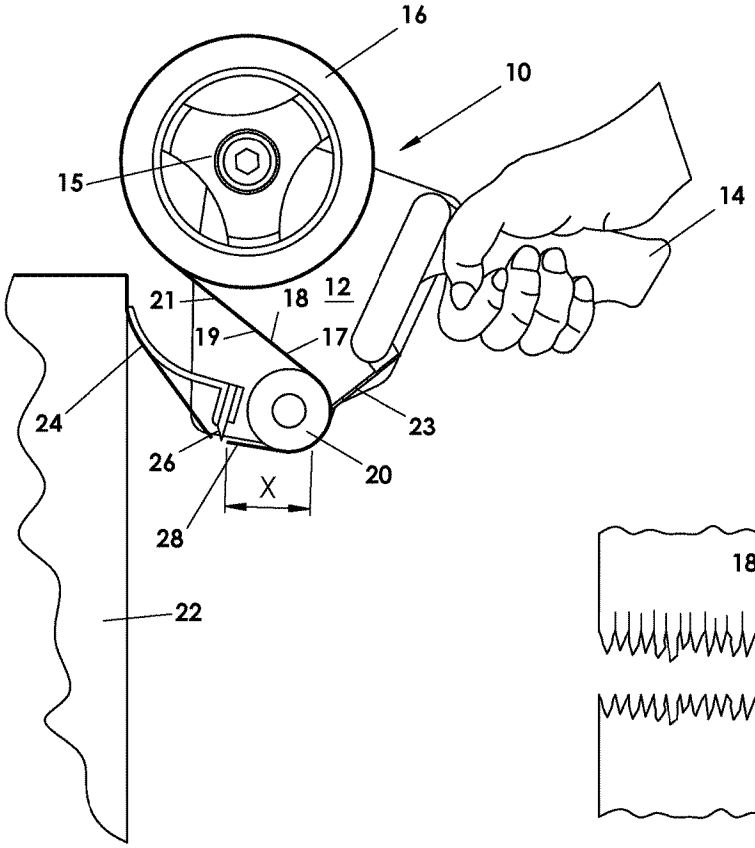
FIG. 1*a* (Prior art) Shows a conventional hand held tape applicator at the moment of completing the carton taping by cutting off the tape and a wiper folding the tape onto the rear vertical surface of the carton with a downwards motion.

FIGS. 1*a* and 1*b* which illustrate the prior art are included to show important short comings of the prior art. The illustrations show a simple version of applicator 10 having a frame 12 handle 14, tape roll mounting 15 with a tape roll 16 mounted thereon. The tape 18 (which has an adhesive side 17 and a non-adhesive side 19 is withdrawn from the roll 16 and passes along tape path 21 and is guided by a guide plate or blade 23 onto an applicator roll 20 that applies the adhesive side 17 of the tape 18 to the object being tape—in the illustrated version a carton 22. A trailing wipe down wiper 24 with a cutoff knife 26 are mounted on the frame 12 ahead of the applicator roll 20 in the direction of movement of the tape 18. (A relatively simple cutoff system including the wipe down wiper 24 and knife has been show but it will be apparent more modern but well know systems with knife guards will normally be used.) FIG. 1*a* shows the source of the problem related to the length of a loose fee end 28 of the tape 18 which is long and has a length indicated by the distance X. This length X is determined by the distance between the cutoff knife 26 and the periphery of the applicator roll 20.

In FIG. 1*b* the problem generated by the length X of the loose end 28 of the tape 18 which is not supported and extends freely from the applicator roll 20 on the side of same remote from the tape roll 16 to be effectively presses onto the vertical surface of the carton. The un-contacted or free end 28 of length X is not in position to be pressed against the carton 22 by the normal action of the tape applicator and has to be pressed against the carton 22 by other means such as by hand. Only the tape 18 on the opposite side of the roll 20 to the free end 28 is applied against the carton 22 by the roll 20. The present invention provides solutions to this deficiency which has persisted for many years.

Figure 2B:
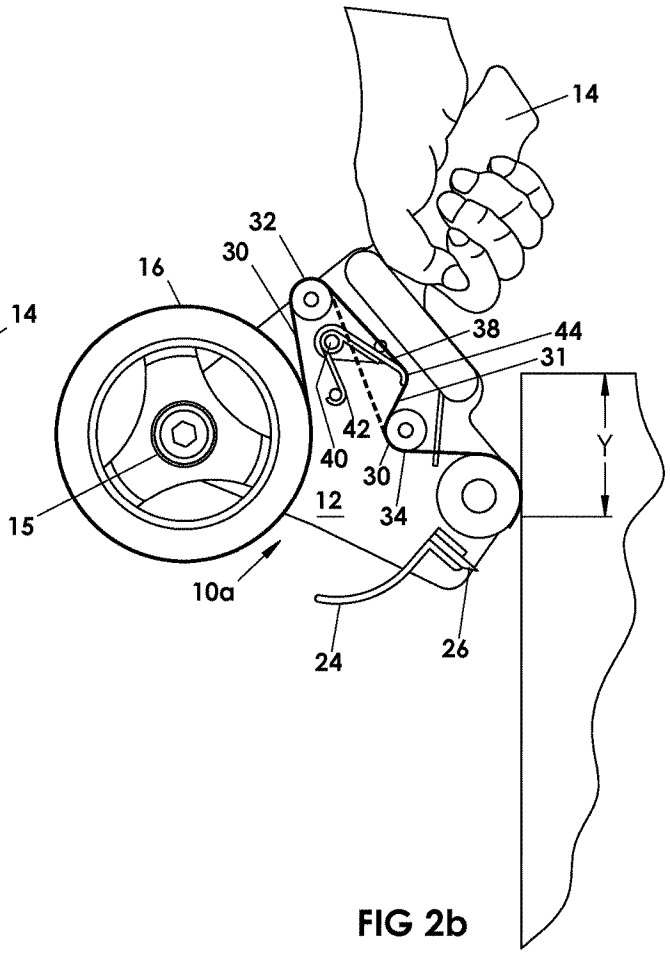
FIG. 2*a* shows a hand applicator of the present invention including a spring bias tape draw-back devise FIG. 2*b* Shows the same hand held tape applicator (FIG. 2*a*) is ready to apply tape onto a in the illustrated arrangement vertical surface of the carton.
Figure 2A:
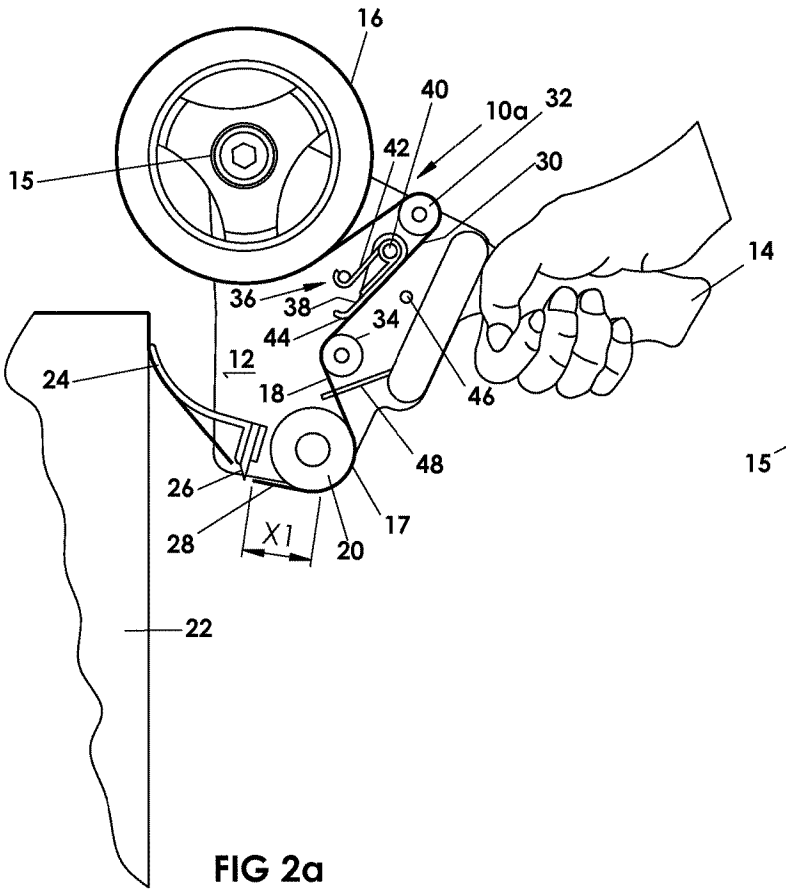

The same reference numerals as used above have been used to indicate equivalent parts of the hand or manual tape applicator 10 shown in FIGS. 2*a* and 2*b* which show a relatively simple fix for the deficiency of the prior art referred to above. FIG. 2*a* which is similar to FIG. 1*a* shows a hand applicator 10*a* wherein the distance between the cutoff knife 26 and the periphery of the applicator roll 20 are the same as in FIG. 1 so that the length X1 of free end 28 formed by the applicator 10*a* is the same that of the free end 28 formed by the prior art applicator 10 of FIGS. 1*a* and 1*b*.

FIG. 1*c* shows the cut edges 500 and 502 formed by the cutting operation of FIG. 1*a* as is apparent from FIG. 1*c* are jagged and even more important the pointed ends or tips of the serrated blades 26 normally used in the industry generate grooves 504 increasing in depth until the tips pass through the tape and complete the cut. The undesirable cut edges 500, 502 shown on FIG. 1*c* is caused by a conventional cutting orientation with the tape path travelling in perpendicular towards the knife when cutting the tape i.e. the entry angle is 90°. The preferred cut edges 600, 602 shown in FIG. 4*c* is achieved with the present invention by changing the tape path angle when cutting the tape will be described below.

The applicator 10*a* illustrated in FIGS. 2*a*, and 2*b* has been modified to provide an different tape path 30 for tape 18 between the periphery of the tape roll 16 which provides a tape source from which the tape 18 is being withdrawn for application by the applicator 10*a* and the applicator roll 20 that applies the adhesive side 17 of the tape 18 to the object being taped in the illustrated case to a carton 22. The tape path 30 is defined by a pair of spaced parallel guide rolls 32 and 34 over which the tape 18 is passed on its way to the applicator roll 20. Located between two rollers 32 and 34 is a tape draw-back device 36 that in the system illustrated in FIGS. 2*a*, 2*b*, 3*a* and 3*b* is formed by a lever arm 38 pivotably mounted on the frame 12 as indicated at 40 and spring biased toward the path 30 between the rolls 32 and 34 by spring 42. The frame 12 of the embodiment of FIGS. 2*a*, and 2*b* may be, if required, slightly modified relative to the frame 12 of FIGS. 1*a* and 1*b* to accommodate the changed path 30 and the draw-back device 36. The arm 38 preferably extends across the full width of the tape 18 and is provided with a curved free end 44 to facilitate passage of the tape 18 there over.

In operation the tension in the tape 18 forces the leaver arm 38 of draw-back 36 to overcome the pressure from spring 42 and move the arm 38 to the position shown in FIG. 2*a* i.e. to make the path 30 between the rolls 32 and 34 relatively straight and thus short. At the moment of cutting the tape 18 by the knife 26 the tension in the tape is eliminated and the spring 42 forces the lever arm 38 against the stop 46 projecting from the frame 12 to an extended position shown in FIG. 2*b* and wherein the path 30 between the rolls 32 and 34 is deformed from the relatively straight path shown in FIG. 2*a* (and in dash lines in FIG. 2*b*) to a curved path 31 shown in FIG. 2*b* so that the length or amount of tape 18 extending between the rolls 32 and 34 in increased. This additional length is obtained by drawing the free end 28 backward along the path 30 toward to roll 16. i.e. the loose or free end portion 28 of the tape 18 which is no longer being held by tension is free to be retracted to form the curved path 31 thereby reducing the excessive amount of un-contacted exposed at the free end of tape 18. By setting the length of tape drawn back by the drawback mechanism 36 the need to hand wipe down on the tail end 28 may be eliminated so that the application roll 20 of the applicator 10*a* can press the tape 18 against the carton 22 over essentially the full length "Y" to the top 46 of the carton 22 i.e. the roll 20 presses the tape 18 against the carton 22 from the initial point of application of the tape 18 to the carton 22 to the top 46 of the carton.

In all the embodiments shown as is well know the applicator roll 20 may be replaced by an applicator wiper and vice-versa. These terms as used herein are to be interpreted accordingly. A suitable guide 48 to inhibit lateral movement of the tape 18 may be provided.

In the embodiment of FIGS. 3 to 6 the length of the loose or free end 128 of the tape 118 using at least one of the mechanisms that are incorporated into this embodiment. i.e. by using a drawback mechanism 150 which is similar to but simpler than the mechanism 36 described above and/or by positioning the free end 152 of the applicator wiper 154 in close proximity to the cutoff knife 156 when the cutoff knife 156 cuts the tape 118 as will be described below.

Figure 3:
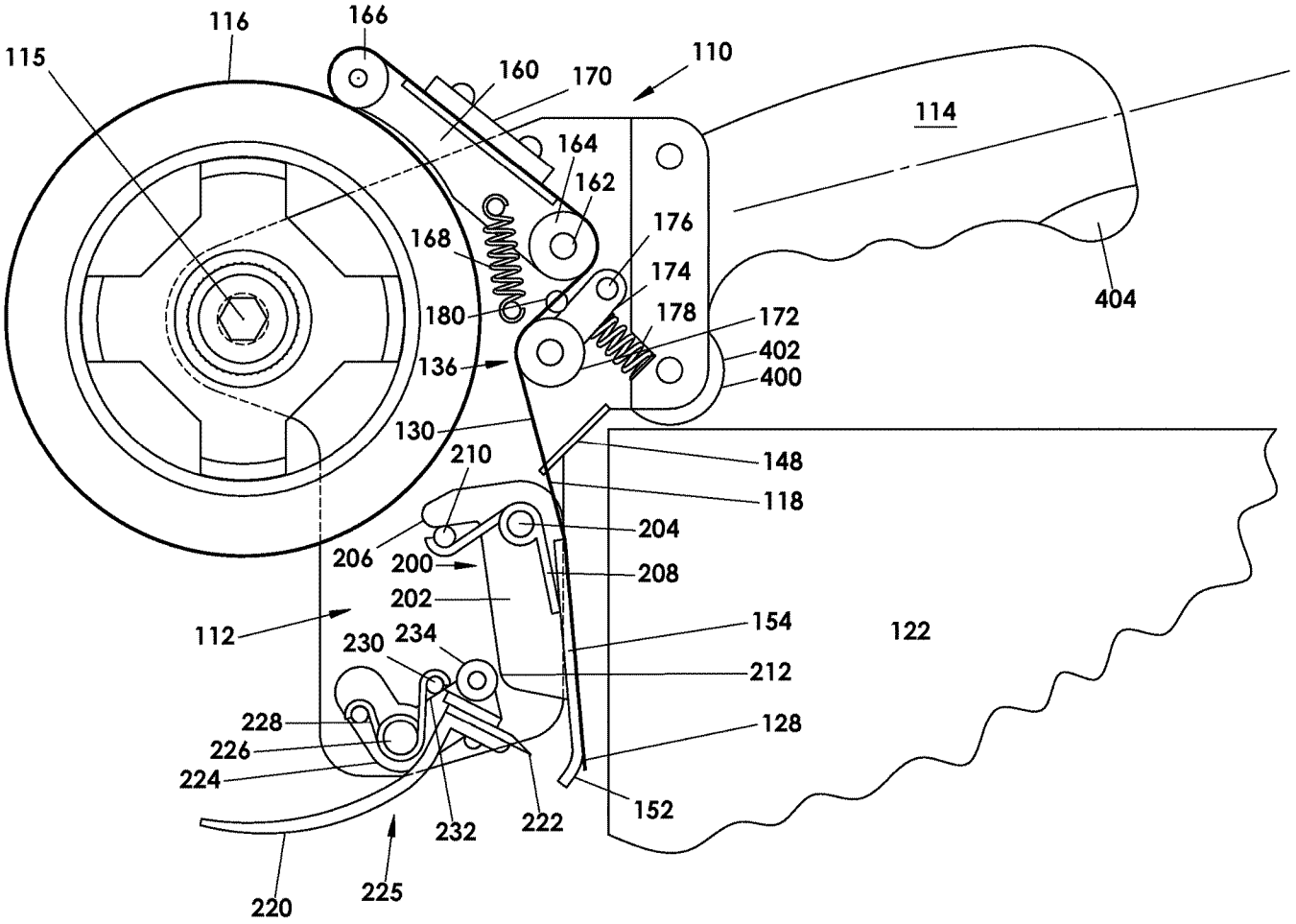
FIG. 3 Shows a hand held tape applicator incorporating the present invention at its normal position ready to apply tape onto the front vertical surface of the carton.
Figures 4, 4A:
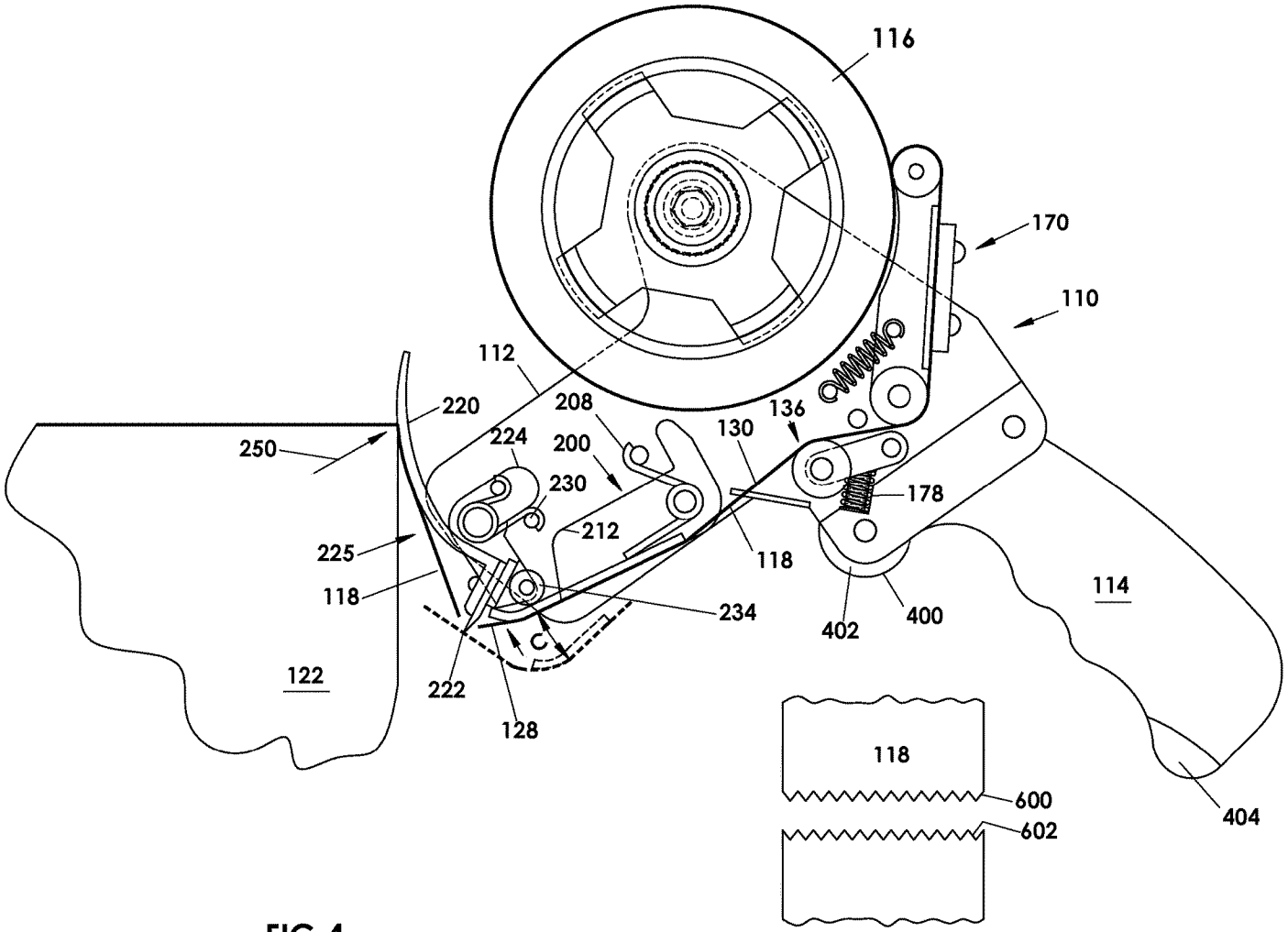
FIG. 4 Shows a tape applicator of FIG. 3 at the moment of tape cutting
FIG. 4*a* Shows adjacent edges on opposite sides of a cut performed using the preferred cut off systems of the present invention (FIGS. 3 to 6 inclusive)

The hand or manually operated tape applicator 110 of FIGS. 3 and 4 includes a frame 112 on which is mounted on a tape roll mounting 115 which in turn mounts a roll 116 from which the tape 118 is to be dispensed.

In the illustrated system a dancer arm 160 is pivotably mounted on the frame 112 adjacent to one end of the arm 160 on axel 162 which also functions as the axel for turning roll 164. Adjacent to the free end of the arm 160 is a nip roll 166 that bears against the outer periphery of the tape roll 116 and is held in contact therewith via spring 168 extending between the arm 160 and the frame 112 and biases the free end of arm 160 and thus nip roll 166 against the tape roll 116.

The dancer arm 160 is not essential to the present invention but if employed may also be used to mount an edge folding station 170 as described in U.S. Pat. No. 8,393,375 issue on Mar. 12, 2013 to Lam the disclosure there is incorporated herein by reference A drawback mechanism 136 that operates in a manner similar to the drawback mechanism 36 described above but incorporates a roller 172 mounted on the free end of an arm 174 which is pivotably mounted on the frame 112 as indicated at 176 at a position spaced from the roll 172. It will be apparent that pivoting of the arm 174 around the mounting 176 moves the roll 172 relative to the tape path 130 to change the length tape path 130 between the path shown in FIG. 3 when the tension in tape 118 has been released and tape path 130 shown in FIG. 4 when the tape 118 is being applied and is under tension. To accomplish this the roll 172 is biased toward the tape path 130 by spring 178 which holds the arm 174 against the stop 180 when there is no tension in the tape and is compressed by the force generated against the roll 172 when tension is applied to the tape 118 and thereby moved to the position shown in FIG. 3. It will be apparent that the pull back mechanisms 36 ad 136 operate in essentially the same way by extending the length of the tape path from the tape roll 16 or 116 to the applicator roll 20 or wiper 154 when the tension in the tape 18 or 118 is released to thereby draw back the free end 28 or 128 of the tape 18 or 118.

The applicator and cutting mechanism of the FIGS. 3 and 4 embodiment is significantly different from the one discussed above with reference to FIGS. 2*a* and 2*b*.

In FIGS. 3 and 4 (and FIGS. 5 and 6) the applicator is in the form of a wiper 154 that is mounted on a mounting arm 202 of an applicator that is in the form of an L shaped lever that is pivotably mounted to the frame 112 as indicated at 204 with the mounting arm 202 on one side of the pivotal mounting 204 and a stop arm 206 of the L shaped lever 200 on the other side of mounting 204. A spring 208 biases the wiper to an extended position wherein the stop arm 206 is forced against a stop 210 fixed to the frame 112. The edge of the arm 202 adjacent to its free end and on the side remote from the wiper 154 provides a cam surface 212 which will be discussed below.

A trailing or activating wiper 220 is used to activate a cutoff knife 222 both of which are mounted on an arm 224 to sever the tape 118 and form important parts of a cutoff mechanism 225. The arm 224 is pivotably mounted on the frame 112 as indicated at 226 and is biased by spring 228 against a stop 230 also fixed to the frame 112. The adjacent edge 232 of the arm 224 cooperates with the stop 230 to stop counterclockwise movement around the mounting 226. It is clearly shown in and evident from FIGS. 3 and 4 that the pivotal mount 226 is positioned on the side of the mounting 204 remote from the tape mounting 115 and that the trailing or activating wiper 220 and the cut off blade 222 extend in crossing relationship to points on opposite sides of the mounting 226 with the cutoff blade 222 closer to the applicator wiper 154 than the activating wiper 220.

Mounted on the arm 224 adjacent to the end of the arm 224 adjacent to the wiper 154 is a cooperating cam 234 which is shown as a cam roller but could equally well be any appropriate cam surface and is positioned to cooperate with the cam 212 on the arm 202 to inhibit or permit relative movement between the applicator formed by the L shape lever 200 and the activating or trailing wiper 220 as will be described.

FIG. 4 illustrates the cutting action of the knife 22. The position of the applicator wiper 154 immediately after the cams 212 and 234 disengage is shown as a solid line and its position before disengagement and immediately after the tape 118 has be cut by the knife in dash lines. Thus only at the time of cutting and for an instant before is the wiper 154 in the solid line position. This disengagement occurs when i.e. the actuating or trailing wiper 220 of the cut off mechanism 225 is rotated as indicated by the arrow 250 to move the arm 224 away from the stop 230 and force the cam 234 to move relative to the cam 212 and disengage there from. As soon as the cams 212 and 234 disengage the tension in the tape 118 reacts against the spring 208 to move the wiper 154 from the dash line position to the solid line position and then the knife 222 of the cutoff mechanism 225 severs the tape 118 which releases the tension and permits the spring 208 to return the wiper 154 to the dash line position.

Until the tape 118 is severed the drawback mechanism 136 is held in the position shown in FIG. 4 i.e. the tension in the tape compresses the spring 178 to define a shorter tape path 130 between the tape roll 116 and the applicator 154 but as soon as the tape is severed by the knife 222 and the tension in the tape relieved the spring 174 moves the drawback mechanism to the position shown in FIG. 3 and increases the length of the path 130 between the tape roll 116 and the wiper 154 and thereby draw the free end 148 of the tape 118 back toward the roll 116 which produces a shorter free leading end on the tape which if sufficiently reduced for a particular operation may replace the drawback mechanism 36 or 136 i.e the drawback mechanism may not be needed assuming the shorter free end of tape so produced is acceptable.

The movement of the wiper to the solid line position shown in FIG. 4 changes the entry angle of the knife 222 and it penetrates and cuts the tape 118 to facilitate cutting.

The cutting operation of the preferred forms of the invention orients the tape 118 relative to the cutting edge 222 by reducing the tape path entry angle or attack angle (angle between the tape and knife as they move relatively to cut the tape 118. Angle C shows the change in angle between the application wiper at the time of application (dash lines) of the tape and the orientation of the wiper at the time of cutting (solid line position) i.e. the cutting angle is not perpendicular as it is with the prior art devices. This orientation of the knife 222 to the tape 18 at the time of cutting generates cut edges 600 and 602 that are essentially the same and does not form a groove equivalent to those shown at 504 in FIG. 1*c*.

It will also be apparent that the wiper when retracted also reduces the distance between the cutting edge 22 and the adjacent end 152 of the wiper 154 (see FIG. 3) and thereby reduce the length of the free end of the tape 118.

Figure 5:
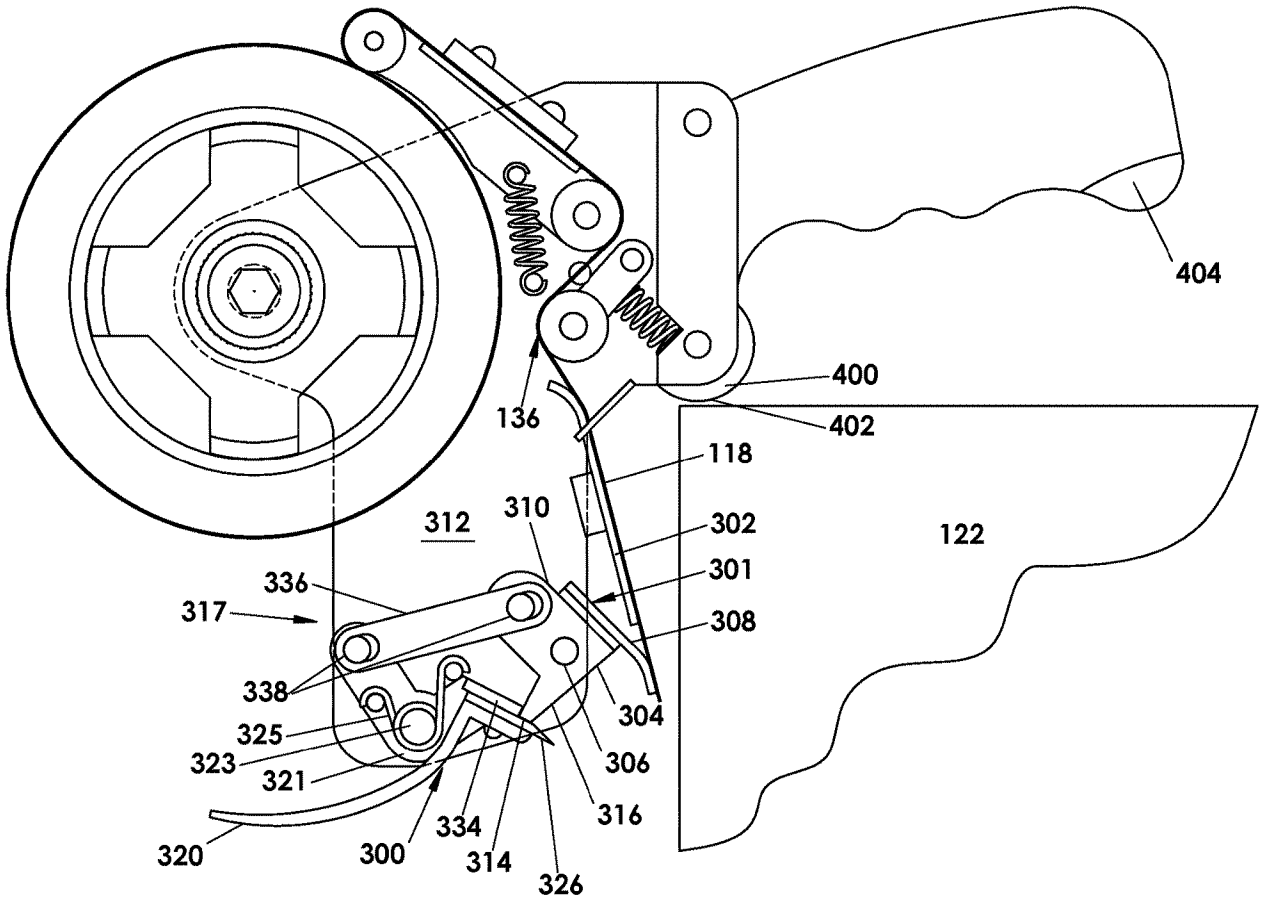
FIG. 5 Shows another version of the hand held tape applicator incorporating the present invention at its normal position ready to apply tape onto the front vertical surface of the carton.
Figure 6:
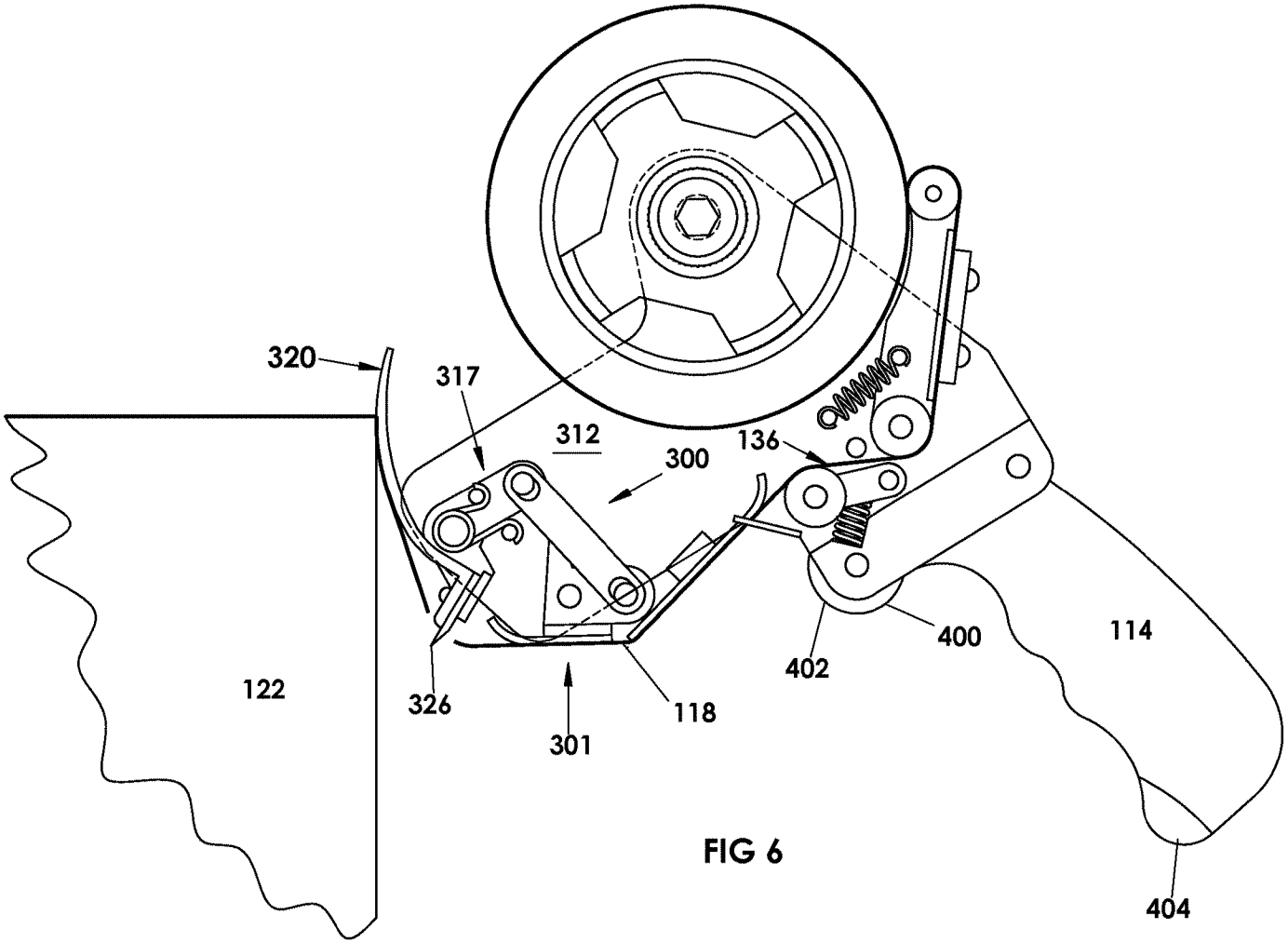
FIG. 6 Shows a tape applicator of FIG. 5 at the moment of tape cutting

FIGS. 5 and 6 illustrate and alternative all be it more complicated cutoff and applicator system that may be employed in place of the system shown in FIGS. 3 and 4. In this embodiment the pullback mechanism and other elements that deliver the tape to the point of application are essentially the same and thus only the downstream changes will be described. In this embodiment the tape 118 is directed from the drawback mechanism 136 to a cut off and applicator mechanism 300 via a guide 302. The applicator portion 301 of the mechanism 300 is formed by an L shaped application lever 304 pivotably mounted on the frame 312 as indicated at 306 and which carries an application or applicator wiper 308 on one arm 310 and the fee end 314 of the other arm 316 that in effect forms a first cam cooperates with a push plate 334 on the mechanism 317 as will be described below.

The cutoff portion 317 of the mechanism 300 is composed of a second L shaped arm 321 pivotably mounted on the frame 312 as indicated at 321 and biased in the counterclockwise direction by a spring 323. Mounted on the arm 321 is a trailing or activating wiper 320 and a cutting knife 326. A push plate 334 that in effect forms a cooperating cam cooperates with the arm 316 adjacent to its free end 314 is mounted on the cutoff portion 317 on the side of knife opposite its cutting edge and positioned to engage with the arm 316 adjacent to the cam 314.

A coupling bar 336 connects the arm 310 to the arm 321 via limited slip connections 338 there by interconnecting the mechanism portions 301 and 317 for combined action.

The system shown in FIGS. 5 and 6 operates as follows the drawback 136 functions as described above based on the tension in the tape 118. At the start of the taping operations the mechanism are in the positions shown in FIG. 5 and when the tape is applied to the carton 122 tension is applied to the tape 118 and the drawback mechanism 136 is moved to the position of FIG. 6. The mechanism 300 is activated by moving the activating or trailing wiper 320 as the taping operation turns about the trailing corner of the carton 122 and is moved into the position shown in FIG. 6. Initial movement of the wiper 320 in the clockwise direction in FIG. 6 rotates the arm 304 via contact of the push plate 334 (which in effect forms a cooperating cam) with the adjacent surface of the arm 316 (which in effect provides a cam) to turn same clockwise about mounting 306 until the free end 314 can pass the push plate 334 at which time the coupling bar forces the arm 304 to rotate in the opposite direction as the trailing wiper continues to move clockwise around the mounting 321. This changes the orientation of the application wiper 308 and moves its free end much closer to the knife 326 to improve the entry angle of the knife 326 as it penetrates and cuts the tape 118 to facilitate cutting and shorten the length of the free end of the tape (as described above with respect to FIGS. 3 and 4).

It will be apparent that the cam 212 and top edge of arm 316 adjacent to the free end 314 thereof act with their respective cooperating cams 234 and 334 as latch cams that free the applicator wipers 154 or 308 to move relative to the frame 112 when released by movement of the trailing or activating wiper 220 or 320 respectively. This release movement is accommodated in the FIGS. 3 and 4 embodiment by deformation of the arm 202 or the cam surface 212 as counter clockwise rotation of arm 202 as shown in these figures is prevented by the stop 210. This similar counter clockwise movement in the FIGS. 5 and 6 embodiment is accommodated by the limited slip connections 338.

As above indicated the device of FIGS. 5 and 6 also reduces the attack angle and shortens the free end of the tape as described above with reference to FIGS. 3 and 4 All of the hand operated applicators may be equipped with an applicator guide that helps the guide the operator to place the tape 18 or 118 in a desire position relative to the article being taped such as a carton (22, 122 etc.). One embodiment of such a guide is illustrated in FIGS. 3, 4, 5 and 6 and another in FIGS. 7*a*, 7*b* and 7*c*. Each includes a guide edge 400 mounted on the frame 12 or 112 and extending parallel to the normal direction of travel of the tape 18, 118 as it is being applied to the carton 22, 122 i.e. the guide edge 400 extends perpendicular to the pivotal axes 40 or 176.

In the version illustrated in FIGS. 3, 4, 5 and 6 the guide 400 is formed provided by a disk or the like 402 and may also include a second edge formed by a flat planar portion 404 projecting from the free end of the handle 14 or 114 and extending in alignment with the plane of the disk 402. The positions of 402 and 404 relative to the width W (see FIGS. 7*a*, 7*b* and 7*c*) of the tape 18 or 118 and operation of the guide 400 will be explained with reference to FIGS. 7*a*, 7*b* and 7*c*.

Figures 7A, 7B, 7C:
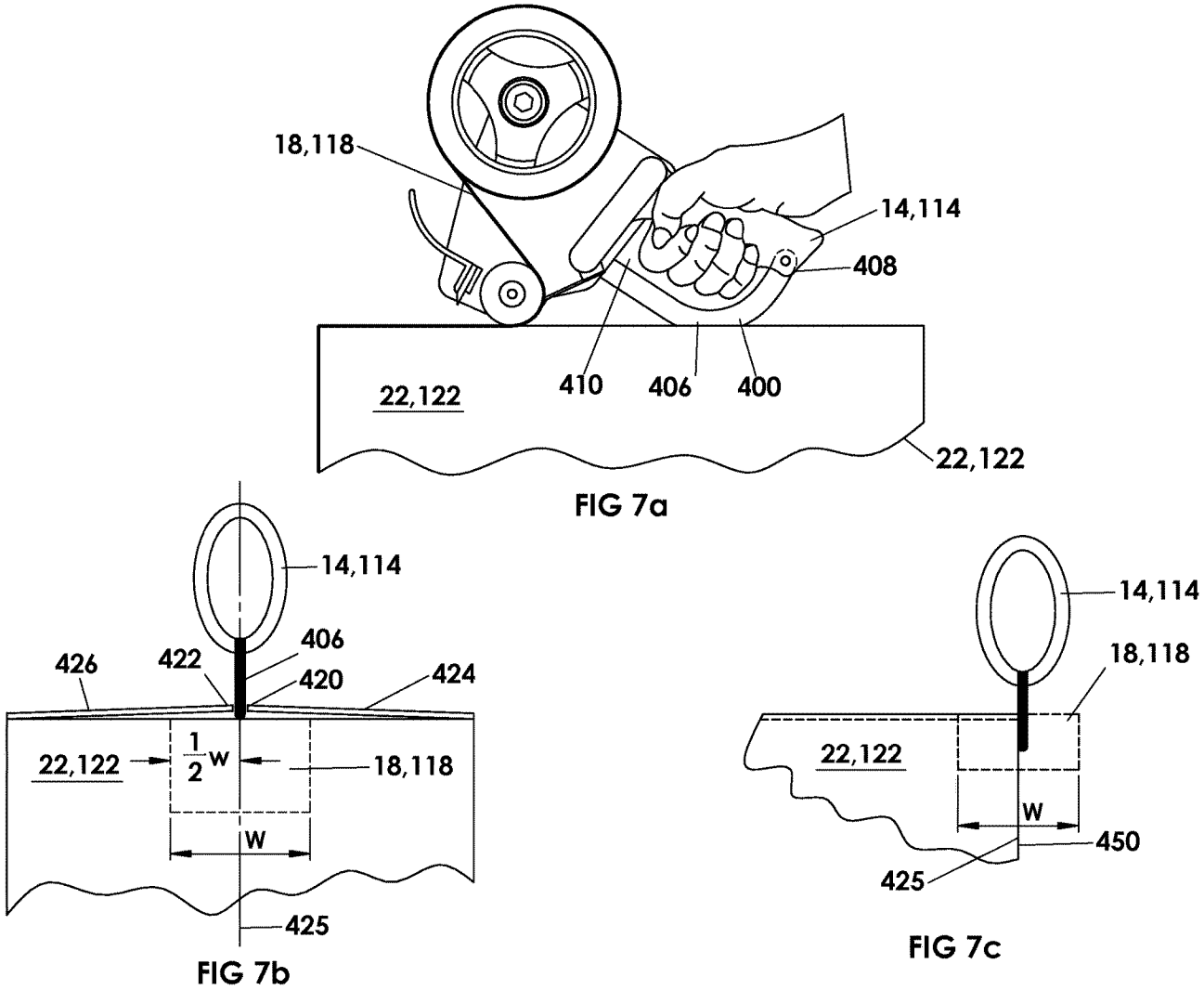
FIG. 7*a* Shows a simplified side elevation illustrating the operation of a preferred form of the operating guide or center guide gauge FIG. 7*b* Is an end elevation showing the guide of FIG. 7*a* positioned in the gap between the adjacent ends of the closing flaps of the carton to guide movement of the applicator.
FIG. 7*c* Is an end elevation showing the guide of FIG. 7*a* positioned at the side of the carton to facilitate application of one half the width of the tape to, in the illustrated application, the top of the carton.

Turning to FIGS. 7*a*, 7*b* and 7*c* the preferred form of guide 400 is shown. In this embodiment a thin guide plate 406 replaces the disk 402 and plainer portion 404 to provide a continuous guide edge extending from the frame 12 or 112 spaced from the adjacent portion of the handle 14, 114 adjacent to its free end as indicated at 408 and defines a hole 410 through which the hand of the operator may be received when the device is in use, so that the guide plate also can function to protect the operator. As is clear from FIG. 7*b* the plane of the guide 406 extend parallel to the direction of travel of the tape and is normally aligned with the center line of the tape i.e. mid width of the tape ½ W having a tape width W.

It is apparent the guide 400 may be used simply as an aiming reference for the operator to initially position the leading end of the tape relative to the carton, however a better way of using the guide 400 is illustrated in FIG. 7*b* and another in 7*c*. In 7*b* the guide is positioned between the adjacent edges 420 and 422 of the closure flaps 424 and 426 of the carton 22, 122 being closed so that the guide 400 is guided for movement parallel to these edges 420 and/or 422 of the closure flaps 424 and 426 to insure the tape 18 or 118 is applied parallel to these edges 420 and 422 and with the guide 400 aligned with the center line 425 of the tape i.e. spaced 1/W from either side of the tape 18 or 118 ensures that essentially the same width of tape is applied to each of the flaps 424 and 426.

In the FIG. 7*c* illustration the guide 400 is positioned in contact with a side 450 of the carton so that ½ W of the Tape 18 or 188 i.e. applied to the adjacent surface of carton 22 or 122 with the other ½ W projecting there from and that may be folded onto the wall 450 to seal the corner of the carton.

Figure 8:
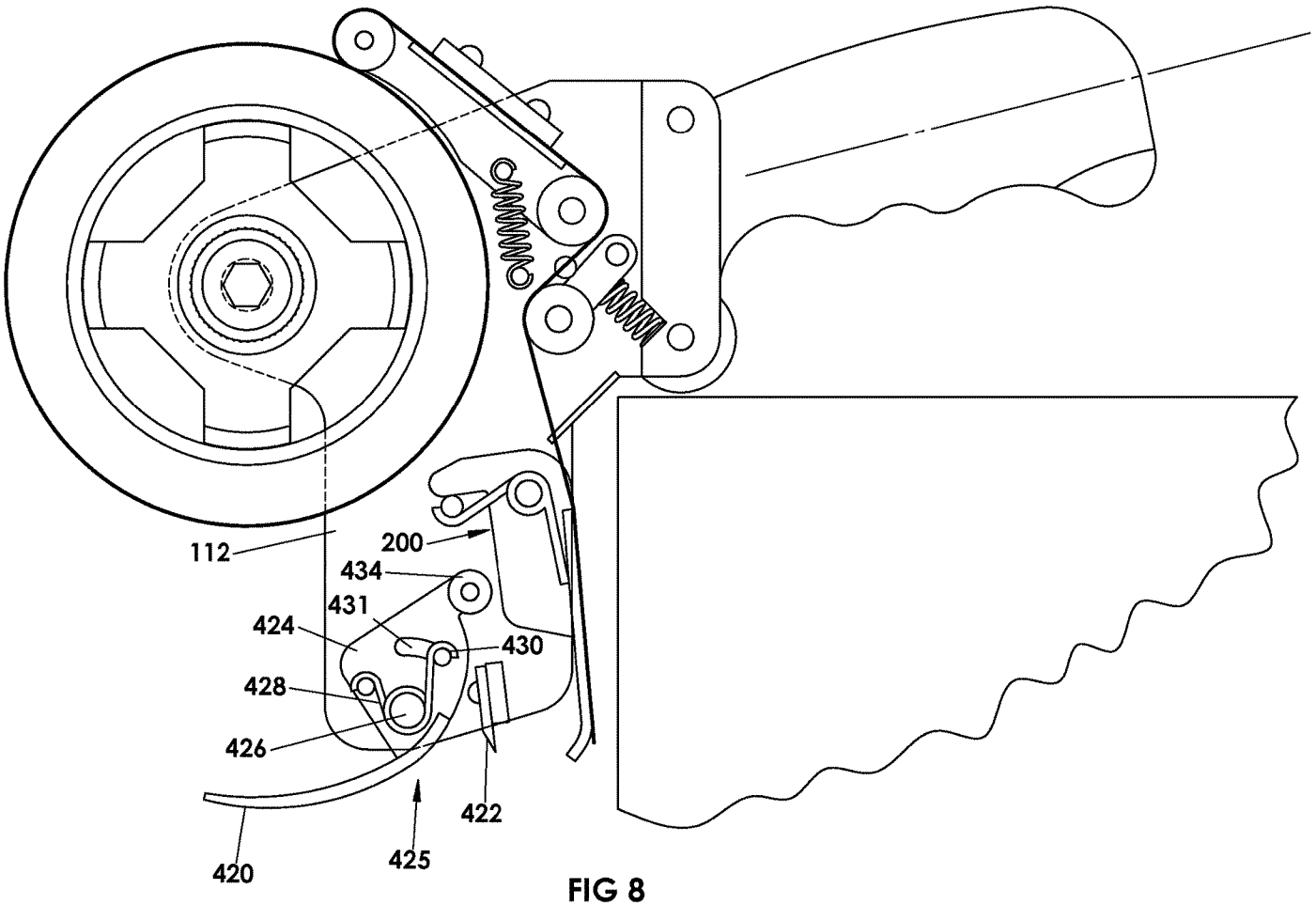
FIG. 8 Shows a cut off system similar to the one in FIGS. 3 and 4 but with the cutting knife fixed to the frame.

In the preferred forms of the invention as illustrated in FIGS. 3 to 6 inclusive the cutting knife 222 and 326 each move relative to the frame 112 and 312 respectively during the cutting operation. FIG. 8 shows a modified version of FIG. 3 wherein the cutting edge 422 is fixed directly to the frame 112. In this arrangement the mechanism 425 equivalent to the mechanism 225 of FIG. 3 includes an arm 424 equivalent to 224 and mounted to the frame 412 in a manner equivalent to the mounting of arm 224 in FIG. 3 via a pivotal mounting 426, spring 428 and includes a stop 430 equivalent to stop 230 except that the stop 430 is received in a slot 431 that permits the arm 424 to pivot around the mounting 426. A cam 434 equivalent to cam 234 cooperates with the cam surface 212 of L shaped lever 200 in the same manner as cams 234 and 212 and functions as latch cam that releases the L shaped arm 200 that is force by tension in the tape 118 to rotate into position where the tape 118 is cut by the knife 422 i.e. the cams 434 and 212 function in the same manner as cams 234 and 212 when the trailing wiper 420 equivalent to wiper 200 is moved to cause rotation of the arm 424.

In the embodiments shown the tape source is a roll mounted on the applicator but any other appropriate tape source may be used. Also in the embodiments shown the applicator 200 is shown pivotably mounted to the frame 112 at 204. The applicator 200 could also be made of resilient material that is deformable by the tension in the tape when the cams 212 and 234 disengage and free the applicator to be moved by the tension in the tape 118. Under these circumstances the up-stream end of the applicator 200 may be fixed as opposed to pivotably mounted relative to the frame.

Having described the invention, modifications will be evident to those skilled in the art without departing from the scope of the invention as defined in the appended claims.

The invention claimed is:

1. A manually operated device for applying tape comprising a frame, a tape source of tape having an adhesive side and a non-adhesive side to be applied by said device mounted on said frame on a tape mounting, a handle extending from said frame, a tape path extending from said tape source to an applicator for applying a leading end of said tape, said applicator pivotably mounted on said frame for rotation about a pivotal axis, said applicator including an application wiper for applying said tape, a spring biasing said applicator from a retracted position toward an initial position where said application wiper is in a position for said applying of said leading end of said tape, an arm, an actuating wiper and a cut off blade mounted on said arm, said arm being mounted on said frame for rotation on a rotational axis located on a side of said pivotal axis remote from said tape source, and actuating wiper and said cut off blade extending beyond said arm in non-parallel directions on opposite sides of said rotational axis and said cut off blade being closer to said applicator than said activating wiper, so that movement of said actuating wiper pivots said arm about said rotation axis which moves said cut off blade across said tape between a retracted position and a cutting position to cut said tape, a first cam connected to and movable with said applicator, a cooperating cam connected to said arm, said first and said cooperating cams cooperating to prevent movement of said applicator until movement of said arm frees said applicator via said first and said cooperating cams.

* * * * *